US009304466B2

(12) United States Patent
Tanonaka

(10) Patent No.: US 9,304,466 B2
(45) Date of Patent: Apr. 5, 2016

(54) IMAGE FORMING APPARATUS

(71) Applicant: KYOCERA Document Solutions Inc., Osaka-shi, Osaka (JP)

(72) Inventor: Atsushi Tanonaka, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/628,073

(22) Filed: Feb. 20, 2015

(65) Prior Publication Data

US 2015/0241831 A1 Aug. 27, 2015

(30) Foreign Application Priority Data

Feb. 24, 2014 (JP) ..... 2014-032760

(51) Int. Cl.
*G03G 15/00* (2006.01)
*G03G 15/20* (2006.01)

(52) U.S. Cl.
CPC ..... *G03G 15/55* (2013.01); *G03G 15/205* (2013.01)

(58) Field of Classification Search
CPC ..... G03G 15/205; G03G 15/55
See application file for complete search history.

(56) References Cited

U.S. PATENT DOCUMENTS 7,109,440 B2 * 9/2006 Lee ..... G03G 15/2039 219/216
2009/0297199 A1 * 12/2009 Yamashina ..... G03G 15/2039 399/70
2012/0177393 A1 * 7/2012 Ikebuchi ..... G03G 15/205 399/69

FOREIGN PATENT DOCUMENTS

JP 2003330314 A 11/2003

* cited by examiner

*Primary Examiner* — David Gray
*Assistant Examiner* — Sevan A Aydin
(74) *Attorney, Agent, or Firm* — Alleman Hall McCoy Russell & Tuttle LLP

(57) ABSTRACT

In an image forming apparatus, a first abnormality detection portion detects an abnormality in a fixing portion based on a change rate of a temperature detected by a temperature detecting portion and a first reference change rate that is set in advance. A first temperature control portion performs a temperature control of a heat source by a first feedback control method based on the temperature detected by the temperature detecting portion. A second temperature control portion performs a temperature control of the heat source by a second feedback control method based on the temperature detected by the temperature detecting portion, the second feedback control method being smaller in temperature change rate than the first feedback control method. A detection prohibiting portion prohibits the abnormality detection by the first abnormality detection portion during the temperature control performed by the second temperature control portion.

6 Claims, 9 Drawing Sheets

IMAGE FORMING APPARATUS

INCORPORATION BY REFERENCE

This application is based upon and claims the benefit of priority from the corresponding Japanese Patent Application No. 2014-032760 filed on Feb. 24, 2014, the entire contents of which are incorporated herein by reference.

BACKGROUND

The present disclosure relates to an image forming apparatus including a fixing device for executing a fixing process on a sheet on which a toner image has been formed.

Conventionally, a fixing device is provided in an image forming apparatus, such as a copier, a printer, and a facsimile which include an electrophotographic image forming portion, and a multifunction peripheral in which functions of these are installed. The fixing device includes a fixing roller and a pressure roller, wherein the surface of the fixing roller is heated by a heat source, and the pressure roller is configured to be rotated while being pressed against the fixing roller. When a sheet with a toner image formed on the surface thereof passes through the fixing device, the sheet is heated while being nipped by the pressure roller and the fixing roller with a certain pressure. This allows the toner to be fused and adhered to the sheet, thereby the toner image is fixed to the sheet.

In general, the heat source provided in the fixing device is controlled such that a surface temperature of the fixing roller reaches a certain target value, the surface temperature being detected by a temperature detecting element such as a thermistor. As the method for controlling the temperature in this way, a so-called ON/OFF control method may be adopted, wherein according to the ON/OFF control method, electricity supply to the heat source is turned ON when the detection temperature is lower than the target value, and turned OFF when the detection temperature is higher than the target value. In that case, however, the temperature of the fixing roller repeats an overshoot and an undershoot with a relatively large amount of overshoot and undershoot, respectively.

In view of the above, the PID (Proportional Integral Derivative Controller) control method may be used as another method for controlling the heat source. The PID control method is a control method for controlling the amount of electricity supply by using, as a control value, a sum of: a value proportional to a deviation between the current temperature and the target value; a value proportional to the integral of the deviation; and a value proportional to the differential of the deviation. In the case of the PID control method, the detected temperature of the fixing roller gradually approaches the target value, without large overshoot or undershoot as in the ON/OFF control method.

Meanwhile, from the viewpoint of improving the user convenience by reducing the warm-up time or the like, the image forming apparatus is required to be able to raise the temperature as quickly as possible when the image forming apparatus is activated, or when it returns from the energy saving mode to the normal mode. In this respect, the PID control method is not suitable as a temperature control method used during the activation of the image forming apparatus or the like because the PID control method allows the temperature of the fixing roller to change with a small change rate.

Thus it may be considered that the ON/OFF control method, which allows the temperature of the fixing roller to change with a relatively large change rate, is used to raise the temperature quickly during the activation of the image forming apparatus or the like, and switches the temperature control method to the PID control method as the temperature of the fixing roller approaches the target value. By performing such a temperature control, it is possible to restrict the overshoot and undershoot, while allowing the temperature of the fixing roller to be stabilized to the target value as quickly as possible.

SUMMARY

An image forming apparatus according to an aspect of the present disclosure includes an image forming portion, a fixing portion, a temperature detecting portion, a first abnormality detection portion, a first temperature control portion, a second temperature control portion, a switching control portion, and a detection prohibiting portion. The image forming portion is configured to form a toner image on a sheet. The fixing portion has a heat source and is configured to fix the toner image formed on the sheet by the image forming portion to the sheet by using heat emitted from the heat source. The temperature detecting portion is configured to detect a temperature of the fixing portion. The first abnormality detection portion is configured to detect an abnormality in the fixing portion based on a change rate of the temperature detected by the temperature detecting portion and a first reference change rate that is set in advance. The first temperature control portion is configured to perform a temperature control of the heat source by a first feedback control method based on the temperature detected by the temperature detecting portion. The second temperature control portion is configured to perform a temperature control of the heat source by a second feedback control method based on the temperature detected by the temperature detecting portion, the second feedback control method being smaller in temperature change rate than the first feedback control method. The switching control portion is configured to, based on a predetermined condition, switch between the temperature control by the first temperature control portion and the temperature control by the second temperature control portion. The detection prohibiting portion is configured to prohibit the abnormality detection by the first abnormality detection portion during the temperature control performed by the second temperature control portion.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes an embodiment of the present disclosure with reference to the drawings. It should be noted that the following description is an example of a specific embodiment of the present disclosure and should not limit the technical scope of the present disclosure.

Figure 1:
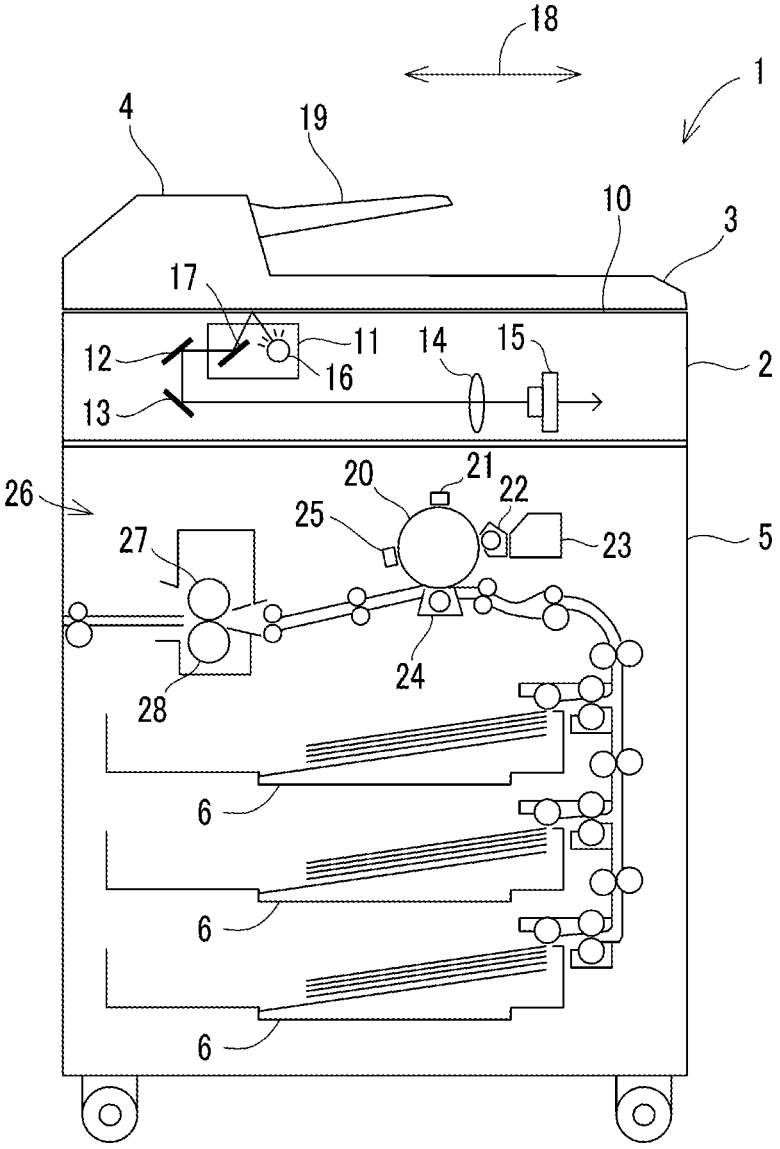
FIG. 1 is a diagram showing the configuration of an image forming apparatus according to an embodiment of the present disclosure.

First, an outlined configuration of an image forming apparatus 1 in an embodiment of the present disclosure is described. The image forming apparatus 1 is a multifunction peripheral having an image reading function, a facsimile function, an image forming function and the like. As shown in FIG. 1, the image forming apparatus 1 includes an image reading portion 2, a document sheet cover 3, an ADF (Auto Document Feeder) 4, an image forming portion 5, and a sheet feed cassette 6. It is noted that although the image forming apparatus 1 which is a multifunction peripheral is described as an example of the image forming apparatus of the present disclosure, the present disclosure is not limited thereto. For example, the image forming apparatus of the present disclosure may be a printer, a facsimile apparatus, or a copier.

The image reading portion 2 executes an image reading process of reading image data from the document sheet. As shown in FIG. 1, the image reading portion 2 includes a contact glass 10, a reading unit 11, mirrors 12, 13, an optical lens 14, a CCD (Charge Coupled Device) 15 and the like.

The reading unit 11 includes an LED light source 16 and a mirror 17, and is configured to be movable in a sub scanning direction 18 (the left-right direction in FIG. 1) by a moving mechanism (not shown) that uses a driving motor such as a stepping motor. While the reading unit 11 is being moved in the sub scanning direction 18 by the driving motor, light is irradiated from the LED light source 16 toward the contact glass 10 provided on the upper surface of the image reading portion 2. This allows the light to be scanned in the sub scanning direction 18.

The mirror 17 reflects, toward the mirror 12, light which was irradiated from the LED light source 16 and reflected on the document sheet or the rear surface of the document sheet cover 3. The light reflected on the mirror 17 is guided into the optical lens 14 by the mirrors 12 and 13. The optical lens 14 condenses the incident light and makes the condensed light incident on the CCD 15.

Figure 3:
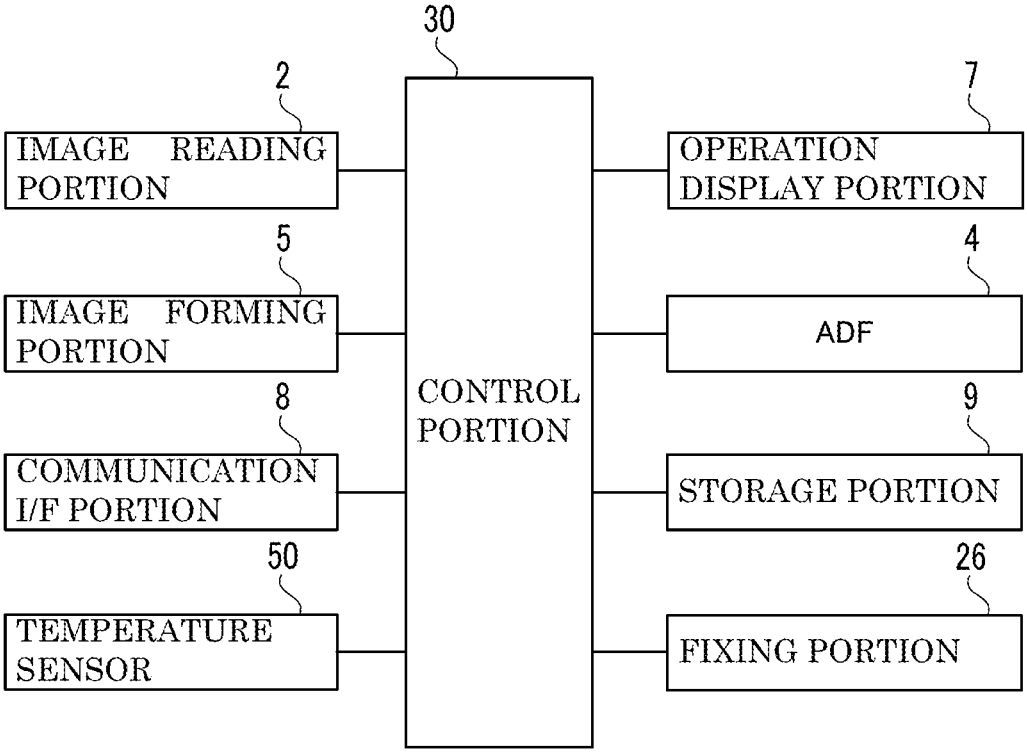
FIG. 3 is a block diagram showing the configuration of the image forming apparatus.

The CCD 15 is a photoelectric converting element which converts the received light into an electric signal (voltage), which corresponds to an amount of the received light (level of brightness), and outputs the electric signal to a control portion 30 (see FIG. 3). The control portion 30 generates image data of the document sheet by performing image processing of the electric signal from the CCD 15.

In the image reading portion 2, the document sheet cover 3 is provided so as to be rotationally moved. When the document sheet cover 3 is rotationally moved, the contact glass 10 on the upper surface of the image reading portion 2 is opened and closed.

Here, the image reading portion 2 reads an image from a document sheet in the following procedure. First, a document sheet is placed on the contact glass 10, and the document sheet cover 3 is closed. Subsequently, when an image reading instruction is input from an operation display portion 7 which is described below, the reading unit 11 is moved rightward in the sub scanning direction 18, while a line of light is continually irradiated from the LED light source 16 in sequence toward the contact glass 10. Light reflected on the document sheet or the rear surface of the document sheet cover 3 is guided into the CCD 15 via the mirrors 17, 12 and 13 and the optical lens 14. Subsequently, light amount data which corresponds to the amount of light received by the CCD 15 is output in sequence from the CCD 15 to the control portion 30. Upon obtaining the light amount data of the whole area on which the light was irradiated, the control portion 30 generates the image data of the document sheet from the light amount data by processing the light amount data.

The document sheet cover 3 includes the ADF 4. The ADF 4 moves one or more document sheets set on a document sheet setting portion 19 in sequence by a plurality of conveyance rollers so that each document sheet passes, rightward in the sub scanning direction 18, an automatic document sheet reading position on the contact glass 10. In the case where the document sheet is moved by the ADF 4, the reading unit 11 is disposed below the automatic document sheet reading position, and the image of the document sheet is read by the reading unit 11 at this position while the document sheet is moving.

As shown in FIG. 1, the image forming portion 5 is an image forming portion based on the electrophotography that executes an image forming process (print process) based on image data which has been read by the image reading portion 2, or based on a print job input from an external information processing apparatus such as a personal computer. The image forming portion 5 includes a photoconductor drum 20, a charging portion 21, a developing portion 22, a toner container 23, a transfer roller 24, an electricity removing portion 25, a fixing device 26 and the like. It is noted that although the image forming portion 5 of the electrophotography is described as an example in the present embodiment, the image forming portion 5 is not limited to the electrophotography, but may adopt an inkjet recording method or other recording or printing methods.

In the image forming portion 5, an image forming process of forming an image on a sheet supplied from the sheet feed cassette 6 is performed in the following procedure. First, when a print job including a print instruction is input from an external apparatus, the charging portion 21 charges the surface of the photoconductor drum 20 uniformly into a certain potential. Next, a laser scanner unit (not shown) irradiates the surface of the photoconductor drum 20 with light based on the image data included in the print job. With this operation, an electrostatic latent image is formed on the surface of the photoconductor drum 20. Then the electrostatic latent image on the photoconductor drum 20 is developed (visualized) into a toner image by the developing portion 22. It is noted that the toner (developer) is supplied to the developing portion 22 from the toner container 23. Subsequently, the toner image formed on the photoconductor drum 20 is transferred to the sheet by the transfer roller 24. After the transfer, the potential of the photoconductor drum 20 is removed by the electricity removing portion 25. Subsequently, the toner image transferred to the sheet is heated so as to be fused and fixed to the sheet when the sheet is passed through the fixing device 26 and then discharged.

Figure 2:
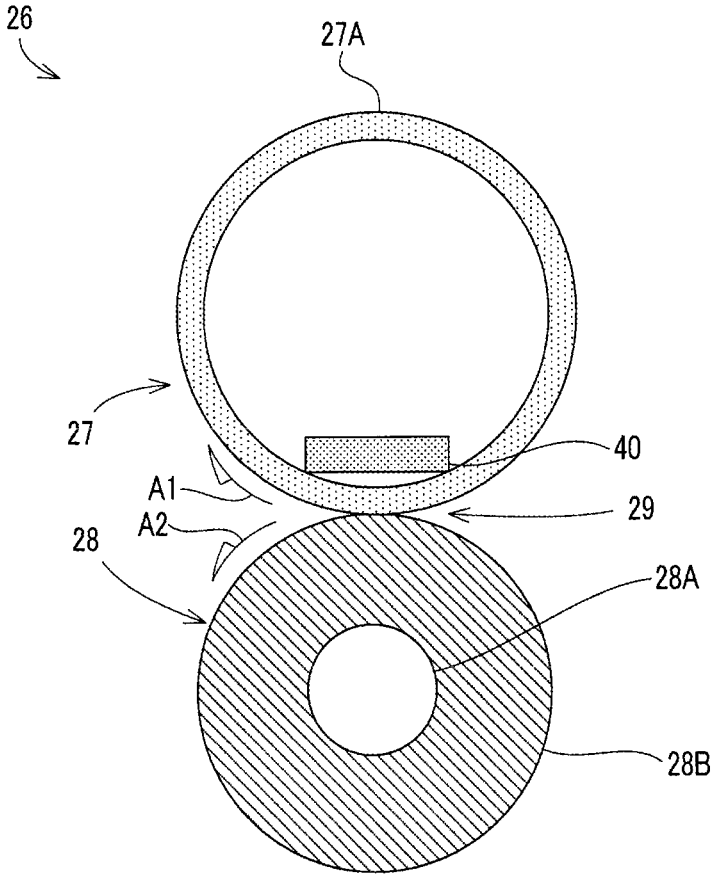
FIG. 2 is a diagram showing the configuration of a fixing portion.

As shown in FIG. 2, the fixing device 26 heats the toner image transferred to the sheet, thereby allowing the toner image to be fused and fixed to the sheet. The fixing device 26 includes a fixing roller 27 and a pressure roller 28.

The fixing roller 27 is an elongated member extending in the front-rear direction of the image forming apparatus 1 (the front-rear direction of the plane of FIG. 1). The fixing roller 27 includes a roller main body 27A formed in a shape of a cylinder. The circumferential surface of the roller main body 27A comes into contact with an image surface of the sheet (a side of the sheet to which the toner image has been adhered) during a fixing process.

The roller main body 27A is made of a material having high thermal conductivity, such as a metal like aluminum. The roller main body 27A is rotatably supported by an elongated guide member that is supported, at opposite ends thereof, by a frame (not shown) of the fixing device 26. The fixing roller 27 rotates following the rotation of the pressure roller 28.

The roller main body 27A is formed to be long enough to contact a sheet that has the maximum width to which the fixing device 26 can fix an image. In the present embodiment, the fixing device 26 can fix an image to a sheet of an A3 size (420 mm×297 mm), and the roller main body 27A is formed to be longer than the short side of the A3 size (297 mm).

The pressure roller 28 is disposed to face the fixing roller 27. The pressure roller 28 is parallel to the fixing roller 27, and is rotatably supported in the state where it is pressed against the surface of the fixing roller 27. The pressure roller 28 includes a spindle 28A at its center. The spindle 28A is rotatably supported by the frame (not shown) of the fixing device 26. This enables the pressure roller 28 to rotate. When a motor (not shown) is rotationally driven, the rotational driving force thereof is transmitted to the pressure roller 28, and the pressure roller 28 rotates in a predetermined direction. In the present embodiment, the pressure roller 28 is rotated counterclockwise in FIG. 2 (see the arrow A2). A cylindrical elastic portion 28B is provided on the spindle 28A of the pressure roller 28, wherein the elastic portion 28B is made of an elastic material such as silicon or porous rubber. The pressure roller 28 is made to pressure-contact the fixing roller 27 by a spring or the like. This allows the elastic portion 28B to be elastically deformed in a shape of a dented curve by the roller main body 27A, and a nip portion 29 is formed therebetween.

A heater 40 is provided, as a heat source, fixedly inside the fixing roller 27, wherein the heater 40 generates heat when an electric current is supplied thereto. As shown in FIG. 2, the heater 40 is attached to an elongated support member (not shown) that is supported, at opposite ends thereof, by the frame (not shown) of the fixing device 26. The heater 40 is composed of, for example, a halogen heater or a ceramic heater, and irradiates heat when power is supplied thereto. With this configuration, the whole roller main body 27A of the fixing roller 27 is heated from inside by the heater 40. In the present embodiment, the heater 40 is fixed at a position that is closer to the nip portion 29 than to the center of the roller main body 27A in a cross section.

In the fixing device 26, the sheet is conveyed to pass through the nip portion 29 from right to left. Being pressure-contacted by the pressure roller 28 that is rotationally driven, the fixing roller 27 follows the rotation of the pressure roller 28 and is rotated clockwise in FIG. 2 (see the arrow A1). As a result, in the nip portion 29, the sheet is conveyed leftward while being nipped by the fixing roller 27 and the pressure roller 28 and receiving heat. At this time, the heat supplied from the fixing roller 27 allows the toner image adhered to the sheet to be fused and fixed to the sheet.

As shown in FIG. 3, in the image forming apparatus 1, the image reading portion 2, the ADF 4, the image forming portion 5, the operation display portion 7, a communication I/F portion 8, a storage portion 9, and a fixing portion 26 are electrically connected to the control portion 30.

The communication I/F portion 8 is an interface that performs a data communication with an external apparatus connected to the image forming apparatus 1 via a communication network such as the Internet or a LAN. The storage portion 9 is composed of a nonvolatile memory such as a hard disk drive (HDD).

The control portion 30 includes a CPU (Central Processing Unit), a ROM (Read Only Memory), and a RAM (Random Access Memory). The CPU is a processor for executing various types of arithmetic processes. The ROM is a nonvolatile storage portion in which various types of information such as control programs for causing the CPU to execute various types of processes are stored in advance. The RAM is a volatile storage portion that is used as a temporary storage memory (working area) for the various types of processes executed by the CPU. The control portion 30 controls the operation of the image processing apparatus 1 by causing the CPU to execute the programs stored in the ROM.

The operation display portion 7 includes an operation portion and a display portion. The operation portion includes various types of push-button keys that are disposed proximate to the display portion, a touch panel sensor disposed on a display screen of the display portion, or the like, wherein various types of instructions are input through the operation portion by the user of the image forming apparatus 1. When the user performs an operation on the operation display portion 7, an operation signal of the operation is output from the operation display portion 7 to the control portion 30. The display portion includes, for example, a color liquid crystal display and displays various types of information to the user operating the operation portion.

The control portion 30 performs a temperature control of the surface temperature of the fixing roller 27 by controlling the electricity supply to the heater 40 of the fixing portion 26. To the control portion 30, a temperature sensor 50 used in this temperature control is electrically connected. The temperature sensor 50 is configured to detect the surface temperature of the fixing roller 27 and is, for example, a contact-type thermistor, a thermocouple, or a non-contact type infrared sensor.

Figure 4:
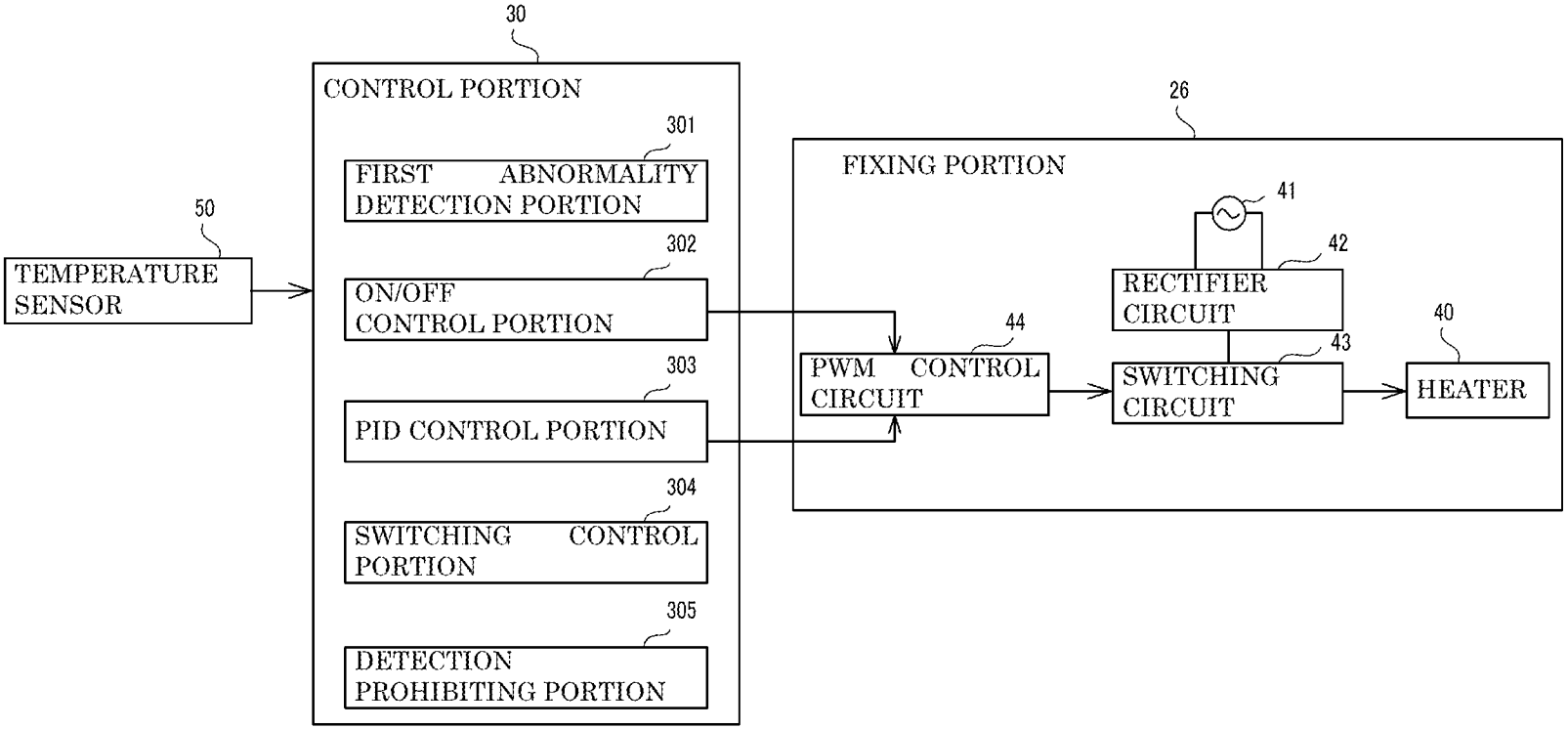
FIG. 4 is a block diagram showing the configuration of a part relating to the fixing operation.

As shown in FIG. 4, the fixing portion 26 includes the heater 40, a rectifier circuit 42, a switching circuit 43, and a PWM (Pulse Width Modulation) control circuit 44. The rectifier circuit 42 rectifies a commercial AC power source 41. The PWM control circuit 44 generates a PWM signal having a duty ratio corresponding to the signal level of the control signal output from the control portion 30. The switching circuit 43 performs a switching operation in response to the PWM signal generated by the PWM control circuit 44. With this configuration, the power rectified by the rectifier circuit 42 is supplied to the heater 40 via the switching circuit 43.

In the present embodiment, as shown in FIG. 3, the control portion 30 realizes, by executing the programs by using the CPU, a first abnormality detection portion 301, an ON/OFF control portion 302, a PID control portion 303, a switching control portion 304, and a detection prohibiting portion 305. It is noted that, as another embodiment, one or more functions of the control portion 30 may be provided as an electronic circuit.

The first abnormality detection portion 301 detects an abnormality in the fixing portion 26 based on a detection temperature Ts detected by the temperature sensor 50. Specifically, the first abnormality detection portion 301 determines whether the surface temperature of the fixing roller 27 is abnormal, based on the change rate of the detection temperature Ts detected by the temperature sensor 50 and a first reference change rate that is set in advance. The first abnormality detection portion 301 is configured to calculate a temperature change ΔTx of the temperature detected by the temperature sensor 50 at every interval of predetermined time T (seconds). In addition, the first abnormality detection portion 301 determines whether or not the surface temperature of the fixing roller 27 is normal, based on whether or not the temperature change ΔTx is within a range of reference change rate from ΔTm1 (° C.) to ΔTm2 (° C.). That is, the first abnormality detection portion 301 determines that the surface temperature of the fixing portion 26 is normal when the temperature change ΔTx is within the above-mentioned range, and determines that the surface temperature of the fixing portion 26 is abnormal when the temperature change ΔTx is outside the above-mentioned range.

Figure 5A:
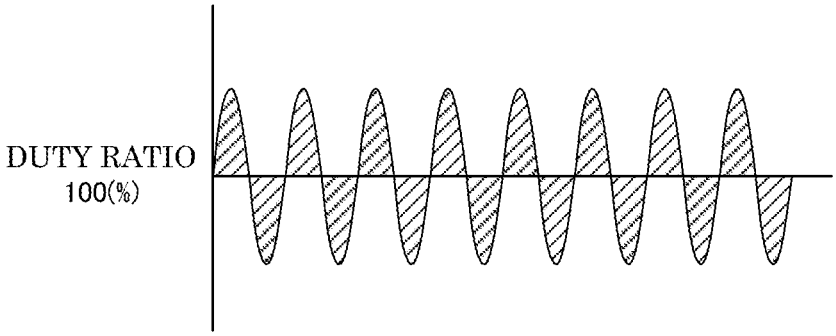
FIGS. 5A and 5B are diagrams showing examples of wave forms of the power supplied to the heater.

The ON/OFF control portion 302 controls the surface temperature of the fixing roller 27 by an ON/OFF control method based on the detection temperature Ts detected by the temperature sensor 50. Specifically, the ON/OFF control portion 302 switches the duty ratio of the PWM signal generated by the PWM control circuit 44 to either 100% or 0% When the duty ratio of the PWM signal is 100%, as indicated by the hatched lines shown in FIG. 5A, the power rectified by the rectifier circuit 42 is supplied to the heater 40 in full wave of the waveform. The ON/OFF control portion 302 is an example of the first temperature control portion, and the ON/OFF control method is an example of the first feedback control method.

Figure 5B:
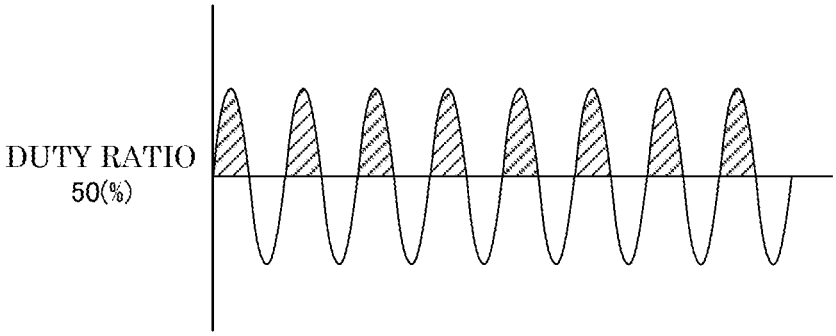

The PID control portion 303 controls the electricity supply to the heater 40 by the PID control method so that the surface temperature of the fixing roller 27 approaches a target temperature Ttg. Specifically, the PID control portion 303 calculates a proportional value by multiplying a predetermined first proportional coefficient by a deviation between a current detection temperature Ts and a target temperature Ttg. In addition, the PID control portion 303 calculates an integrated value by multiplying a predetermined second proportional coefficient by an integral value of the deviation. Furthermore, the PID control portion 303 differentiates the deviation and calculates a differentiated value by multiplying a predetermined third proportional coefficient by a differential value of the deviation. Subsequently, the PID control portion 303 calculates a control value by adding up the proportional value, integrated value, and differentiated value, and controls the surface temperature of the fixing roller 27 by outputting a control signal representing the control value to the PWM control circuit 44. The duty ratio of the PWM signal calculated by the PID control portion 303 changes in a range from 0% to 100%. When the duty ratio of the PWM signal is 50%, as indicated by the hatched lines shown in FIG. 5B, the power rectified by the rectifier circuit 42 is supplied to the heater 40 in half wave of the waveform. The PID control portion 303 is an example of the second temperature control portion, and the PID control method is an example of the second feedback control method.

The switching control portion 304 switches the temperature control of the fixing roller 27 between the temperature control by the ON/OFF control portion 302 and the temperature control by the PID control portion 303, based on the temperature detected by the temperature sensor 50. Specifically, when the image forming apparatus 1 is activated (powered on) or during a warm-up in which the image forming apparatus 1 returns from the power saving mode to the normal mode, the switching control portion 304 causes the ON/OFF control portion 302 to perform the temperature control of the fixing roller 27 until the temperature detected by the temperature sensor 50 reaches a threshold Tth1 (during the time period A shown in FIG. 6). In addition, after the detection temperature reaches the threshold Tth1, the switching control portion 304 causes the PID control portion 303 to perform the temperature control of the fixing roller 27 during a period until the image forming apparatus 1 is powered off or transitions to the power saving mode (during the time period B shown in FIG. 6).

Figure 6:
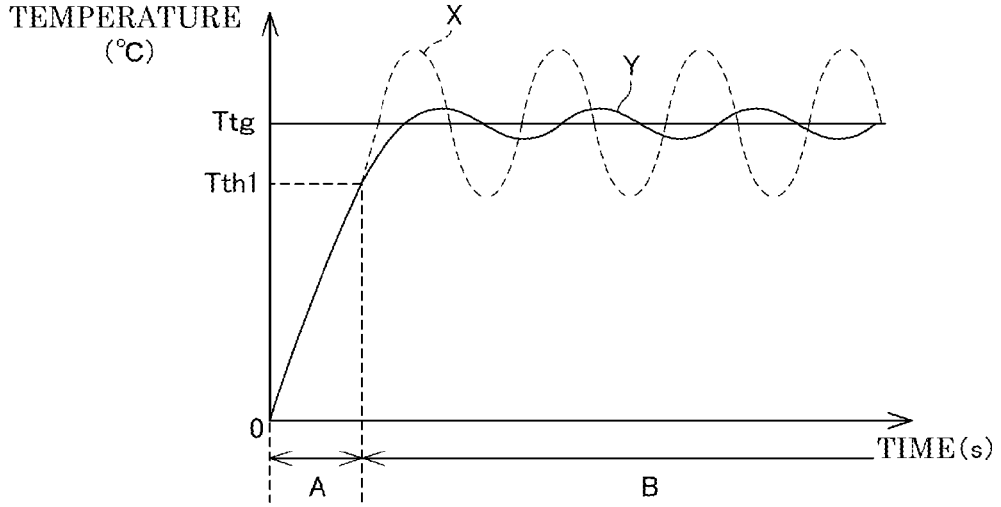
FIG. 6 is a graph showing temperature changes caused by temperature controls in a first embodiment.

The temperature control method is switched as described above for the following reasons. That is, the temperature control by the ON/OFF control method has a higher temperature change rate than that by the PID control method. As a result, the ON/OFF control method is more preferable, than the PID control method, for the temperature control during the warm-up in which reduction of the time taken until the temperature reaches a certain target temperature is required. On the other hand, as shown in FIG. 6, the temperature control by the PID control method (see the solid line Y) has smaller amounts of overshoot and undershoot than the temperature control by the ON/OFF control method (see the dotted line X). That is, the temperature control by the PID control method has higher temperature stability of the heater 40 than the temperature control by the ON/OFF control method. As a result, as the temperature control in the state where the surface temperature of the fixing roller 27 is close to the target temperature, the temperature control by the PID control method is more preferable than that by the ON/OFF control method. Due to these reasons, switching is performed between the two temperature control methods.

Meanwhile, as described above, in the image forming apparatus 1, the temperature of the fixing roller 27 is monitored. When the temperature change rate goes out of a predetermined appropriate range, it may be determined that an abnormality has occurred to the fixing portion 26. Here, the appropriate range is determined so that an abnormality in the fixing portion 26 can be detected as soon as possible.

As a result, in a configuration, as in the above-described configuration, where the temperature control of the fixing portion 26 is performed by switching between a plurality of temperature control methods including the PID control method, an erroneous detection may occur if, during a temperature control using the plurality of temperature control methods, an abnormality in the fixing portion 26 is detected based on an appropriate range that is common to the plurality of temperature control methods. For example, when a temperature abnormality determination is performed based on a predetermined appropriate range that has been determined based on the change rate in the ON/OFF control that has higher change rate of the fixing temperature than the PID control, the change rate of the fixing temperature goes out of the appropriate range with ease during the PID control. On the other hand, when a temperature abnormality determination is performed based on a predetermined appropriate range that has been determined based on the change rate in the PID control, the change rate of the fixing temperature goes out of the appropriate range with ease during the ON/OFF control.

In view of the above, in the present embodiment, the detection prohibiting portion 305 prohibits the abnormal detection by the first abnormality detection portion 301 during the temperature control performed by the PID control portion 303. The reason for this is as follows. That is, since the temperature control by the PID control method has a lower temperature change rate than that by the ON/OFF control method, if the range of reference change rate from ΔTm1 (° C.) to ΔTm2 (° C.) is used in the abnormality determination during the temperature control by the PID control portion 303, the temperature change rate of the surface temperature of the fixing roller 27 may go outside of the appropriate range during the PID control. As a result, the detection prohibiting portion 305 prohibits the abnormal detection by the first abnormality detection portion 301 during the temperature control by the PID control portion 303, thereby preventing the change rate of the fixing temperature from going outside of the appropriate range and restricting an erroneous detection of abnormality.

In the present embodiment, the control portion 30 performs the temperature abnormality determination based on the surface temperature itself of the fixing roller 27, as well as based on the change rate of the surface temperature of the fixing roller 27. That is, the control portion 30 determines whether or not the surface temperature of the fixing roller 27 is within a certain appropriate range. It is noted here that, in the case of the PID control method, since the change amount of temperature near the target temperature is small, the surface temperature of the fixing roller 27 hardly goes out of the appropriate range. Therefore, no problem occurs if the abnormality detection by the first abnormality detection portion 301 is not performed.

Next, the temperature control performed by the control portion 30 is described with reference to FIG. 7. The temperature control is performed when, for example, the main power source of the image forming apparatus 1 is turned on. It is noted that, in the flowchart of FIG. 7, steps S1, S2, . . . represent numbers of the processing procedures (steps).

Figure 7:
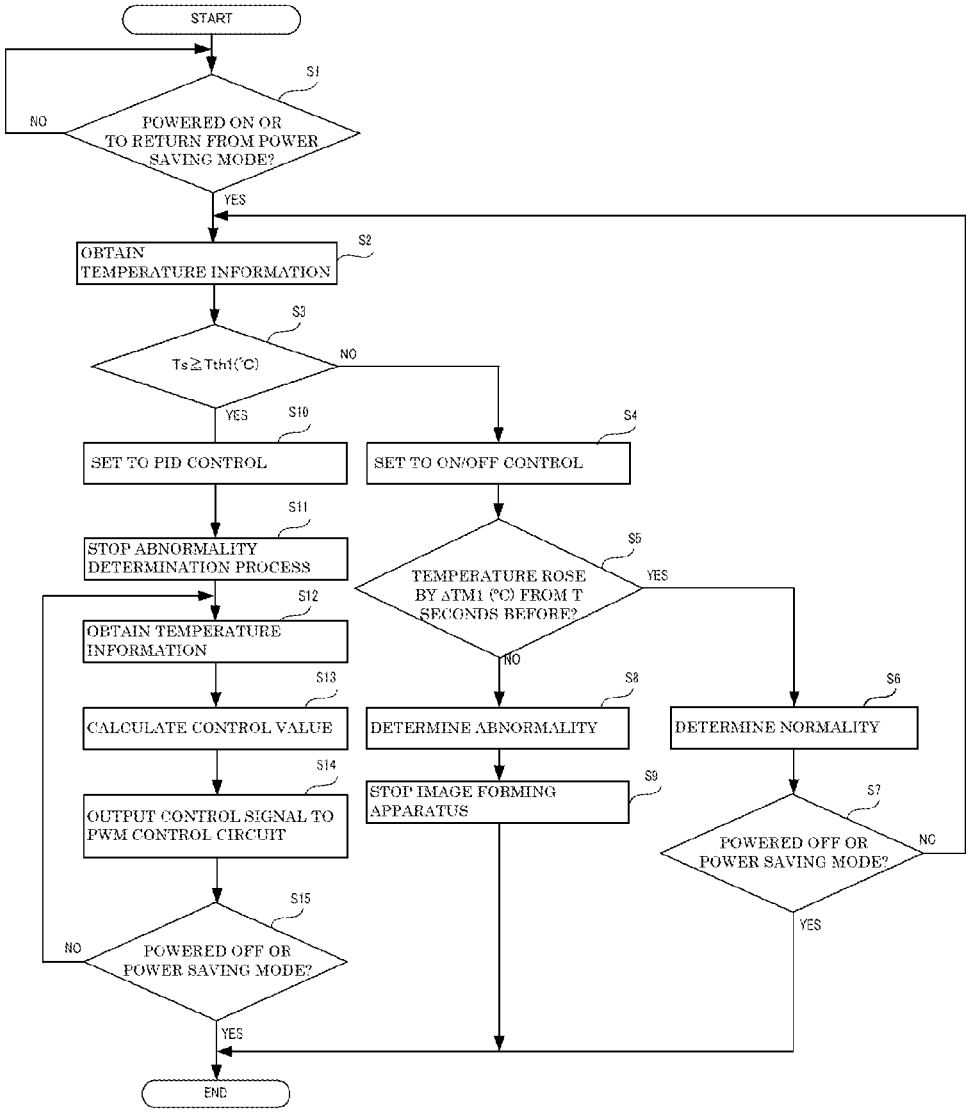
FIG. 7 is a flowchart of a temperature control performed by a control portion.

As shown in FIG. 7, the control portion 30 determines whether or not the power source of the image forming apparatus 1 has been turned on and whether or not the image forming apparatus 1 is to return from the power saving mode (step S1). When the control portion 30 determines that the power source of the image forming apparatus 1 has not been turned on, nor is the image forming apparatus 1 to return from the power saving mode (NO in step S1), the control portion 30 executes step S1 again. On the other hand, when the control portion 30 determines that the power source of the image forming apparatus 1 has been turned on, or that the image forming apparatus 1 is to return from the power saving mode (YES in step S1), the control portion 30 obtains the detection temperature detected by the temperature sensor 50 (step S2). It is noted that, for example, the image forming apparatus 1 is to return from the power saving mode when image data was input to the image forming apparatus 1 and the image forming process is to be started based on the image data.

Subsequently, the switching control portion 304 determines whether or not the detection temperature Ts detected by the temperature sensor 50 is equal to or higher than the threshold Tth1 (step S3). Upon determining that the detection temperature Ts is lower than the threshold Tth1 (NO in step S3), the switching control portion 304 sets the temperature control method of the fixing roller 27 to the ON/OFF control method, namely allows the ON/OFF control portion 302 to start processing (step S4).

The first abnormality detection portion 301 determines whether or not the temperature rise during a period from T seconds before to the current time is equal to or more than ΔTm1 (° C.) (step S5). Upon determining that the temperature rise during the period from T seconds before to the current time is equal to or more than ΔTm1 (° C.) (YES in step S5), the first abnormality detection portion 301 determines that the temperature change of the fixing roller 27 is normal (step S6). Subsequently, the control portion 30 determines whether or not the power source of the image forming apparatus 1 has been turned off and whether or not the image forming apparatus 1 has been set to the power saving mode (step S7), and upon determining that the power source of the image forming apparatus 1 has not been turned off, nor has the image forming apparatus 1 been set to the power saving mode (NO in step S7), the control portion 30 returns to step S2. On the other hand, upon determining that the power source of the image forming apparatus 1 has been turned off, or the image forming apparatus 1 has been set to the power saving mode (YES in step S7), the control portion 30 ends the series of processes.

Upon determining in step S5 that the temperature rise during the period from T seconds before to the current time is less than ΔTm1 (° C.) (NO in step S5), the first abnormality detection portion 301 determines that the temperature change of the fixing roller 27 is abnormal (step S8). Subsequently, the control portion 30 stops operations of the portions of the image forming apparatus 1 (step S9), and ends the series of processes.

Upon determining in step S3 that the detection temperature detected by the temperature sensor 50 is equal to or higher than the threshold Tth1 (YES in step S3), the switching control portion 304 sets the temperature control method of the fixing roller 27 to the PID control method, namely allows the PID control portion 303 to start processing (step S10).

The detection prohibiting portion 305 prohibits the abnormal detection by the first abnormality detection portion 301 (step S11). This makes it possible to restrict an erroneous detection of abnormality in the case where the temperature control of the fixing roller 27 is performed by switching the temperature control method from the ON/OFF control method to the PID control method.

The PID control portion 303 obtains the detection temperature detected by the temperature sensor 50 (step S12), and calculates a control value with respect to the duty ratio of the PWM signal (step S13). The PID control portion 303 outputs a control signal representing the calculated control value to the PWM control circuit 44 (step S14). It is noted that when the surface temperature of the fixing roller 27 reaches the target temperature Ttg, the image forming portion 5 starts the image forming process, or is placed under a state where it can start the image forming process. Subsequently, the control portion 30 determines whether or not the power source of the image forming apparatus 1 has been turned off and whether or not the image forming apparatus 1 has been set to the power saving mode (step S15). Upon determining that the power source of the image forming apparatus 1 has not been turned off, nor has the image forming apparatus 1 been set to the power saving mode (NO in step S15), the control portion 30 returns to step S12. On the other hand, upon determining that the power source of the image forming apparatus 1 has been turned off, or the image forming apparatus 1 has been set to the power saving mode (YES in step S15), the control portion 30 ends the series of processes.

Up to now, a preferable embodiment of the present disclosure has been described. However, the present disclosure is not limited to the embodiment described so far, but is applicable to various modifications.

In the above-described embodiment, the ON/OFF control method is adopted as the temperature control method used during the warm-up (the first feedback control method), and the PID control method is adopted as the temperature control method used after a completion of the warm-up (the second feedback control method). However, the present disclosure is not limited to this configuration. That is, as far as the temperature change rate during the temperature control by the second feedback control method is lower than the temperature change rate during the temperature control by the first feedback control method, specific types of the first and second feedback control methods are not limited to the above-described ones.

As described above, in the case of the PID control method, the amount of temperature change is small near the target temperature and the surface temperature of the fixing roller 27 hardly goes out of the appropriate range. Therefore, in the above-described embodiment, during the temperature control by the PID control method, from the viewpoint that no problem occurs if the abnormality detection based on the temperature change rate is not performed, the temperature abnormality detection by the first abnormality detection portion 301 is prohibited.

Figure 8:
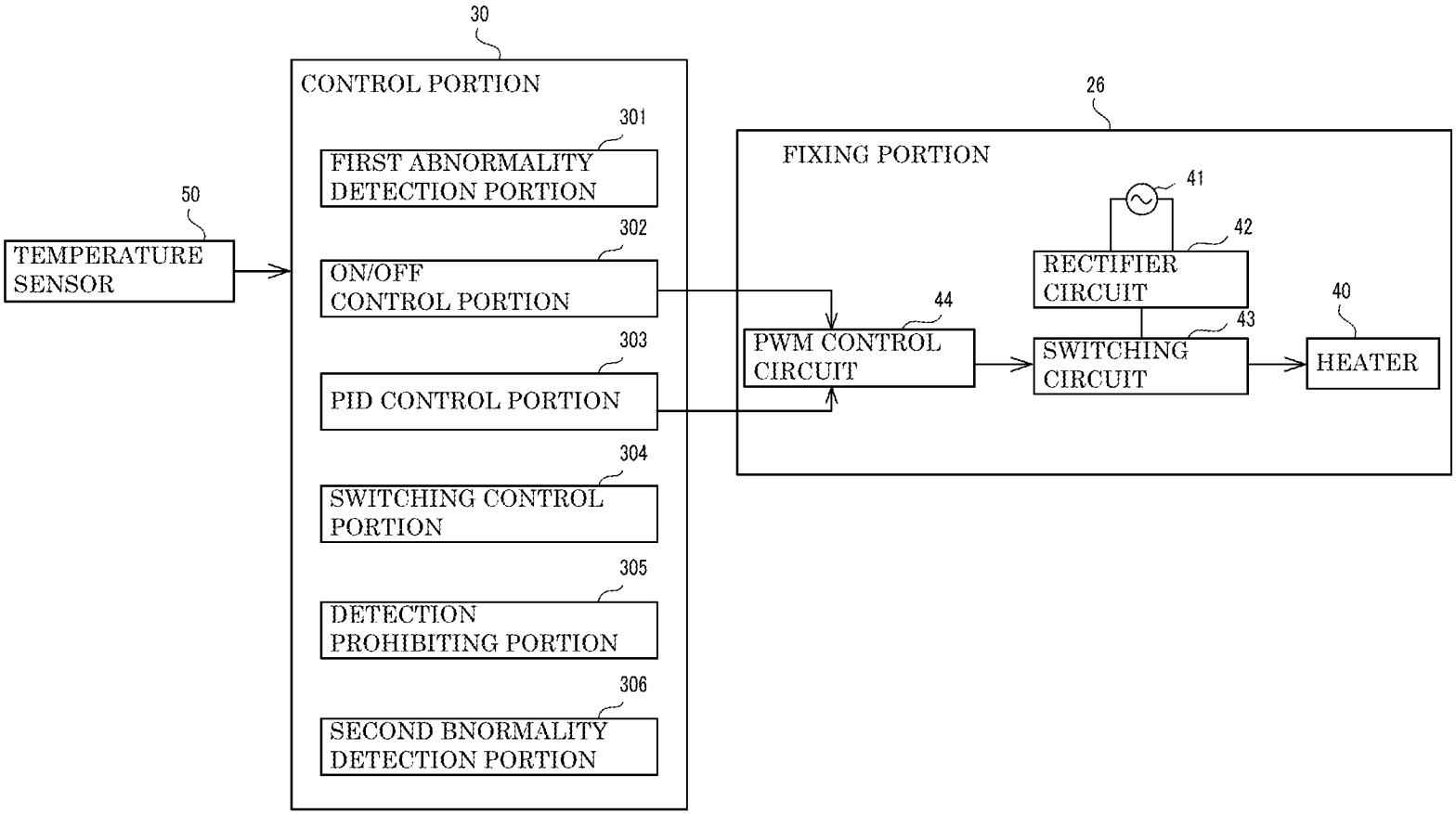
FIG. 8 is a block diagram showing a modified configuration of the image forming apparatus.

However, the temperature abnormality detection using the temperature change rate is preferably performed even during the temperature control by the PID control method. As a result, the image forming apparatus 1 may be configured as follows. That is, as well as the first reference change rate that is used in the abnormality determination during the temperature control by the ON/OFF control method, the second reference change rate that is used in the abnormality determination during the temperature control by the PID control method may be set in advance. In addition, as shown in FIG. 8, a second abnormality detection portion 306 may be provided, wherein the second abnormality detection portion 306 detects an abnormality in the fixing roller 27 based on the change rate of the temperature detected by the temperature sensor 50 and the second reference change rate. The second abnormality detection portion 306, during the temperature control by the PID control method, performs the temperature abnormality detection using the temperature change rate based on the change rate of the temperature detected by the temperature sensor 50 and the second reference change rate. This allows a temperature abnormality of the fixing roller 27 after a completion of the warm-up to be detected appropriately.

Figure 9:
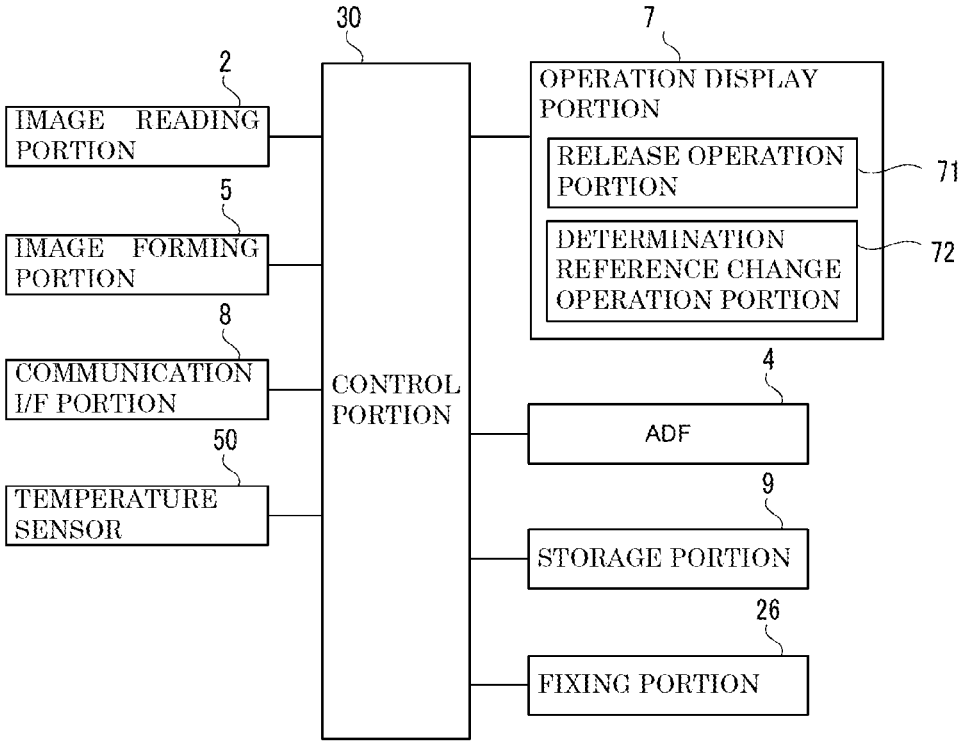
FIG. 9 is a block diagram showing another modified configuration of the image forming apparatus.

As shown in FIG. 9, a release operation portion 71 may be provided, wherein the release operation portion 71 is configured to, in response to a user operation, release the prohibition of the abnormality detection by the detection prohibiting portion 305. It is noted here that when the release operation portion 71 releases the prohibition of the abnormality detection, a temperature abnormality of the fixing roller 27 may be detected frequently. To avoid such a situation, as shown in FIG. 9, a determination reference change operation portion 72 may further be provide, wherein the determination reference change operation portion 72 is configured to change the first reference change rate in response to a user operation such that the above-described situation is avoided by causing the determination reference change operation portion 72 to set the first reference change rate as appropriate.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

an image forming portion configured to form a toner image on a sheet;

a fixing portion having a heat source and configured to fix the toner image formed on the sheet by the image forming portion to the sheet by using heat emitted from the heat source;

a temperature detecting portion configured to detect a temperature of the fixing portion;

a first abnormality detection portion configured to detect an abnormality in the fixing portion based on a change rate of the temperature detected by the temperature detecting portion and a first reference change rate that is set in advance;

a first temperature control portion configured to perform a temperature control of the heat source by a first feedback control method based on the temperature detected by the temperature detecting portion;

a second temperature control portion configured to perform a temperature control of the heat source by a second feedback control method based on the temperature detected by the temperature detecting portion, the second feedback control method being smaller in temperature change rate than the first feedback control method;

a switching control portion configured to, based on a predetermined condition, switch between the temperature control by the first temperature control portion and the temperature control by the second temperature control portion;

a detection prohibiting portion configured to prohibit the abnormality detection by the first abnormality detection portion during the temperature control performed by the second temperature control portion;

an operation display portion configured to output an operation signal in response to a user operation; and a release operation portion included in the operation display portion and operated when the prohibition of the abnormality detection by the detection prohibiting portion is to be released, wherein when the release operation portion is operated by a user, an operation signal for releasing the prohibition of the abnormality detection by the detection prohibiting portion is output to the detection prohibiting portion such that the prohibition of the abnormality detection by the detection prohibiting portion is released.

2. The image forming apparatus according to claim 1, wherein the switching control portion causes the first temperature control portion to perform the temperature control during a warm-up in which the temperature detected by the temperature detecting portion changes from being lower than a predetermined temperature to reaching the predetermined temperature, and causes the second temperature control portion to perform the temperature control after the warm-up is completed.

3. The image forming apparatus according to claim 1, wherein the first feedback control method is an ON/OFF control method in which an electricity supply to the heat source is turned ON and OFF, and the second feedback control method is a control method in which an amount of the electricity supply to the heat source is varied based on a deviation between the temperature detected by the temperature detecting portion and a predetermined target temperature.

4. The image forming apparatus according to claim 1, wherein the predetermined condition is a condition where the temperature detected by the temperature detecting portion is equal to or higher than a predetermined temperature.

5. The image forming apparatus according to claim 1 further comprising a second abnormality detection portion configured to detect an abnormality in the fixing portion based on a change rate of the temperature detected by the temperature detecting portion and a second reference change rate that is set in advance, wherein the second abnormality detection portion detects an abnormality in the fixing portion during a period in which the second temperature control portion performs the temperature control.

6. The image forming apparatus according to claim 1 further comprising a determination reference change operation portion included in the operation display portion and operated when the first reference change rate is to be changed in response to a user operation, wherein when the determination reference change operation portion is operated by the user, an operation signal for changing the first reference change rate is output to the first abnormality detection portion such that the first reference change rate is changed.

* * * * *